US007011578B1

(12) United States Patent
Core

(10) Patent No.: US 7,011,578 B1
(45) Date of Patent: Mar. 14, 2006

(54) PLENUM AND DIFFUSER FOR HEATING, VENTILATING AND AIR CONDITIONING APPLICATIONS

(75) Inventor: William Roger Core, Tulsa, OK (US)

(73) Assignee: R.C. Air Devices, LLC, Tulsa, OK (US)

( * ) Notice: Subject to any disclaimer, the term of this patent is extended or adjusted under 35 U.S.C. 154(b) by 24 days.

(21) Appl. No.: 10/749,789

(22) Filed: Dec. 31, 2003

(51) Int. Cl.
*F24F 13/08* (2006.01)

(52) U.S. Cl. ..... 454/292

(58) Field of Classification Search ..... 454/292, 454/275, 293, 294
See application file for complete search history.

(56) References Cited

U.S. PATENT DOCUMENTS

| | | | | |
|---|---|---|---|---|
| 3,125,943 A | | 3/1964 | Geocaris et al. | 98/40 |
| 3,299,797 A | | 1/1967 | Dry | 98/40 |
| 3,386,367 A | * | 6/1968 | Pellegrino | 454/302 |
| 3,701,895 A | * | 10/1972 | Sweetser | 362/264 |
| 3,909,589 A | | 9/1975 | Stone et al. | 219/361 |
| 4,748,900 A | | 6/1988 | Swin, Sr. et al. | 98/40.09 |
| 4,909,405 A | | 3/1990 | Kerr, Jr. | 220/3.9 |
| 5,016,525 A | * | 5/1991 | Weck | 454/299 |
| 5,795,220 A | | 8/1998 | Core | 454/292 |
| 5,860,548 A | | 1/1999 | Kerr, Jr. | 220/3.2 |
| 6,030,287 A | * | 2/2000 | Core | 454/292 |
| 6,168,285 B1 | | 1/2001 | Flohre | 362/96 |
| 6,168,517 B1 | * | 1/2001 | Cook | 454/269 |
| 6,458,028 B1 | * | 10/2002 | Snyder | 454/292 |

* cited by examiner

*Primary Examiner*—Derek S. Boles
(74) *Attorney, Agent, or Firm*—Gable & Gotwals

(57) ABSTRACT

A plenum and diffuser for use with an HVAC system for distributing air through an opening in a ceiling, the plenum having a large diameter bottom opening by which air is passed through an opening in the ceiling, and having an air inlet opening. A hanger bar extends through the plenum housing over the large diameter opening. A junction box is secured to the hanger bar for supporting a light fixture or ceiling fan. A diffuser is in the form of a planar, circular structure of thin, rigid material having a circumferential outer edge and a central opening dimensioned to accommodate a junction box. The diffuser has a plurality of radially extending fins and a radially extending air slot opening in conjunction with each fin.

8 Claims, 7 Drawing Sheets

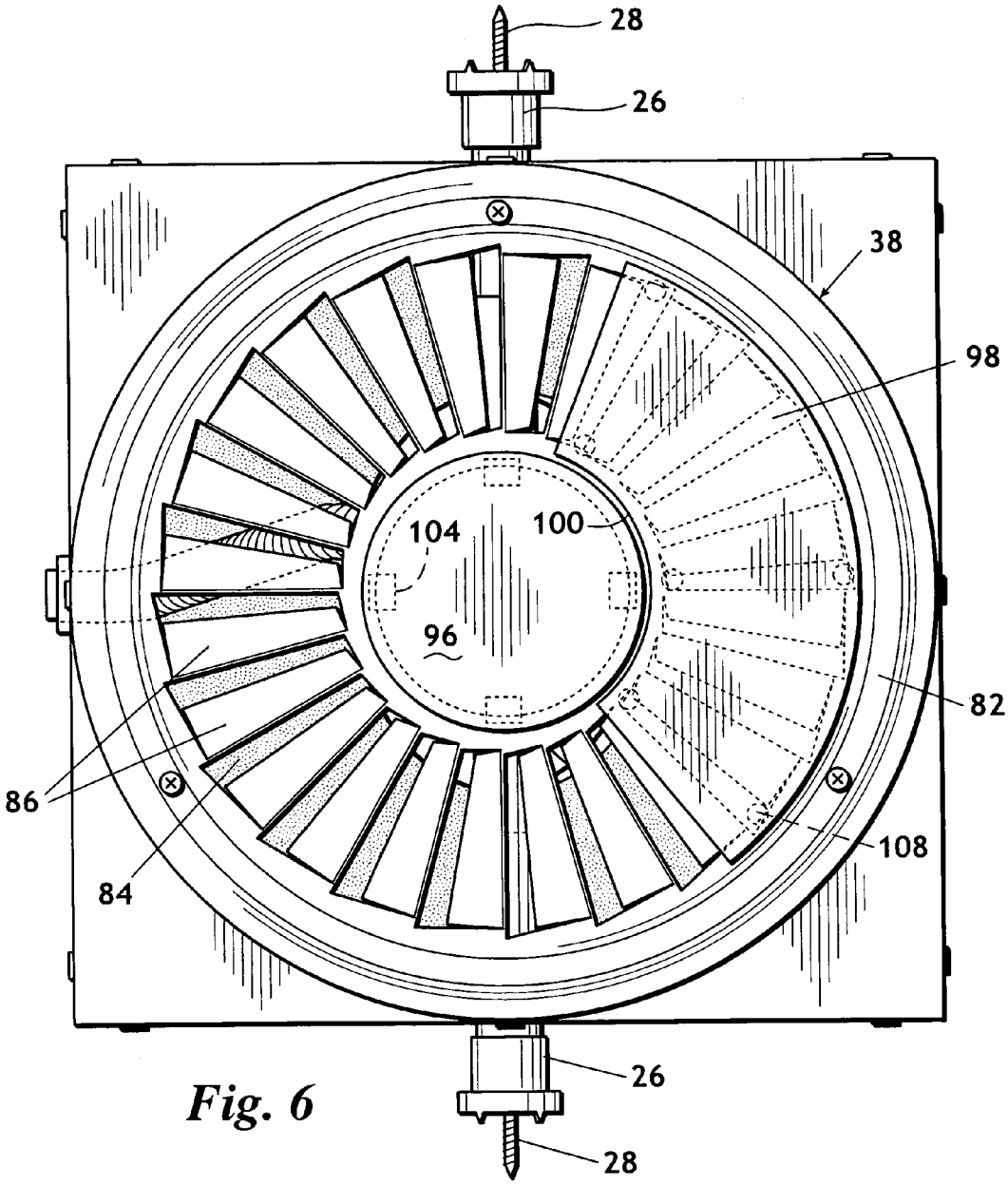
Fig. 6
Fig. 7A
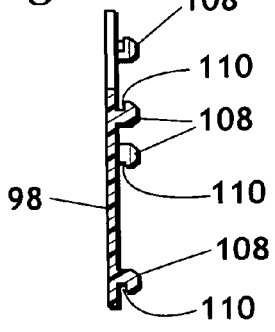
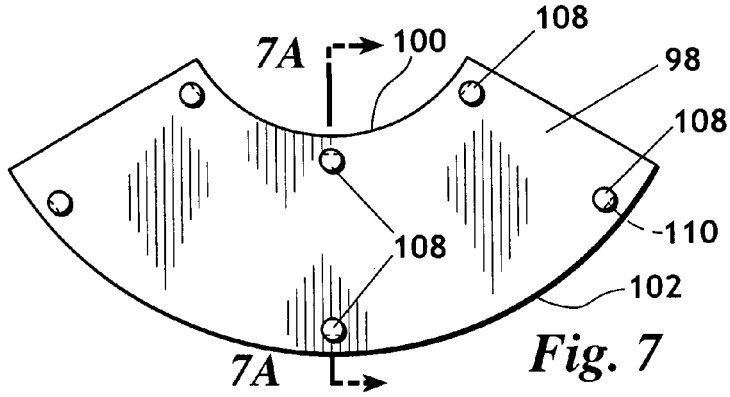
Fig. 7

PLENUM AND DIFFUSER FOR HEATING, VENTILATING AND AIR CONDITIONING APPLICATIONS

REFERENCE TO PENDING APPLICATIONS

This application is not based upon any pending domestic or international United States patent application.

REFERENCE TO MICROFICHE APPENDIX

This application is not referenced in any microfiche appendix.

FIELD OF THE INVENTION

The invention herein relates to the field of heating, ventilation and air conditioning distribution systems and particularly to a plenum and a diffuser for use therewith.

BACKGROUND OF THE INVENTION

Most buildings in the United States and other industrialized countries of the world at the present time have built-in heating, ventilating and air conditioning systems. Whether such buildings are homes, offices, schools, distribution facilities, warehouses, manufacturing facilities or the like, most buildings have some facilities for circulating air. Usually the circulated air is recirculated and passes through a system by which the air is either heated, cooled or filtered so as to provide a desirable environment in which to live or work.

To distribute air from a forced air system into a room, a common practice is to introduce the forced air through a ceiling vent. A typical ceiling vent is designed not only to provide an opening through which air passes into a room but also to aid in distributing or diffusing the air in a room. Another desired aspect of a ceiling vent is to provide an improved appearance—that is, to provide a way for air to enter a room that is other than simply a hole in the ceiling with which an air duct connects.

A common means of improving the comfort of a room is by the use of a ceiling fan. Ceiling fans are employed throughout the world and typically consist of a motor having a vertical shaft attached to a hub from which a plurality of blades radially extend. The typical ceiling fan has relatively large blades and the fan is designed to turn the blades at relatively low rpms so as to achieve good distribution of air without producing excessive noise. Ceiling fans are typically mounted so that the motor is in close proximity to the blades and the motor, having the blades extending therefrom, is suspended on a vertical rod. The upper end of the rod is affixed to a hanger by which the weight of the ceiling fan is supported and in an arrangement that provides for making electrical connection to the fan. An improved plenum and diffuser of this invention is particularly adaptable for use with a ceiling fan installation.

For background information relating to the invention herein, reference is specifically made to the following previously-issued United States patents, each of which is incorporated herein by reference: (a) U.S. Pat. No. 5,795,220 entitled, CEILING FAN WITH AN AIR DIFFUSER SYSTEM issued on Aug. 18, 1988; and (b) U.S. Pat. No. 6,030,287 entitled, SYSTEM FOR DISTRIBUTING AIR THROUGH A CEILING IN A ROOM issued on Feb. 29, 2000. The U.S. and foreign patents cited in these two previously-issued patents may also be relevant.

For additional background information see the following previously-issued U.S. patents:

| Country | Patent Number | Issued | Title |
|---|---|---|---|
| US | 3,125,943 | Mar. 24, 1964 | Combined Lighting and Ventilating Fixture |
| US | 3,299,797 | Jan. 24, 1967 | Combined Air Diffuser and Lighting Fixture |
| US | 3,701,895 | Oct. 31, 1972 | Combined Lighting and Ventilating Fixture |
| US | 3,909,589 | Sept. 30, 1975 | Modular Heating, Lighting and Ventilating Unit |
| US | 4,748,900 | Jun. 7, 1988 | Ducted Ventilator |
| US | 4,909,405 | Mar. 20, 1990 | Interjoint Hanger Assembly and Attachable Support Box Therefor |
| US | 5,795,220 | Aug. 18, 1998 | Ceiling Fan With An Air Diffuser System |
| US | 5,860,548 | Jan. 19, 1999 | Junction Box For Ceiling Fan Support |
| US | 6,030,287 | Feb. 29, 2000 | System for Distributing Air Through a Ceiling in a Room |
| US | 6,168,285 | Jan. 2, 2001 | Universal, Light Fixture/Ceiling Fan Recessed Mounting Device |
| US | 6,168,517 | Jan. 2, 2001 | Recirculating Air Mixer and Fan With Lateral Air Flow |
| US | 2001/0027086 | [Pub. Date] Oct. 4, 2001 | Diffuser and Ceiling Fan Combination |

BRIEF SUMMARY OF THE INVENTION

The invention herein is for use in a heating, ventilating and air conditioning system that is frequently referred to in the trade as a HVAC system. The invention herein is for distributing air through an opening in a horizontal ceiling. The invention includes an improved plenum in the form of a housing having a horizontal bottom. The housing further has a first and a second vertical end wall and a first and a second vertical sidewall. A sloped top is connected to the upper ends of each of the end walls and each of the sidewalls. The plenum housing bottom has a large diameter opening therein by which air is passed from the plenum through a ceiling and into the room with which the plenum is used.

The plenum housing first end is a substantially larger in area than the second end. The first and second sides are of equally dimensioned trapezoids. The sloped top of the plenum has an air inlet opening and a short length flange to telescopically receive an air distribution duct.

A telescopically extending hanger bar is positioned through small diameter openings in the opposed sidewalls and centrally over a large diameter opening in the plenum bottom.

A junction box is supported to the hanger bar, the junction box being centered over the large diameter bottom opening. The junction box provides means for supporting a light fixture or a ceiling fan to the plenum and provides a container for receiving electrical connections.

A flexible shielded electrical cable extends through an opening in one of the side and end walls and is connected to the junction box by which electrical energy is passed through the plenum to the junction box.

A diffuser is removably affixed to the housing bottom. The diffuser has an outer, circular circumferential edge and a central opening therein that exposes the junction box supported by the hanger within the plenum.

The diffuser has a plurality of integrally-formed radial veins that extend from adjacent the central opening to adjacent the circumferential edge.

The diffuser of this invention that is particularly adaptable for use with a plenum positioned above a ceiling by which air is passed through the ceiling into a room is a generally planar integral circular structure formed of a rigid material, such as sheet metal. The diffuser has an uninterrupted circular outer edge and a central opening dimension to accommodate an electrical junction box. Further, the diffuser has a pluralitively radially extending partially punched out fins that (after being punched) are each bent to extend at a common angle to the plane of the diffuser, each bent fin providing a radially extending air slot opening.

In a preferred arrangement, the diffuser is further defined by an integrally formed concentric circular forwardly protruding smudge ring. The integral smudge ring is thereby circumferentially positioned between the fins and the circular outer edge.

As an optional feature, a circular planar cap is provided that is removably attachable to the diffuser and dimensioned so that when attached, the central opening through the diffuser is closed but leaving the radially extending air slot openings unobstructed. An additional further feature includes a planar damper configured to removably cover a preselected number of the radial slot openings. The damper has integral retention means in engagement with the diffuser to provide a way of selectably regulating the total area of exposed radially extending air slot openings.

Further objects and features of the invention will be apparent upon reference to the following detailed description of the preferred embodiments and the claims, taken in conjunction with the attached drawings.

BRIEF DESCRIPTION OF THE DRAWINGS

FIG. 6 is a bottom plan view of the plenum as shown in FIGS. 2 and 3, and showing the installation of a unique diffuser of this invention. The diffuser provides for a plurality of radially extending air distribution slots. In the arrangement of FIG. 6, the diffuser is shown as equipped with a circular shield closing a center opening in the diffuser. Further, this view shows a removable damper by which a preselected number of radially extending air slots are covered to thereby regulate the total cross-sectional area through which air can pass through the diffuser. The embodiment FIG. 6 shows the diffuser as employed with a plenum wherein neither a ceiling fan nor a light fixture is used—that is, where the plenum and diffuser provide only for the passage of air.

FIG. 7 is a plan view of a damper as illustrated in FIG. 6.

FIG. 8 shows the bottom view of the diffuser without the ancillary center shield or damper, as is referenced in FIGS. 6 and 7.

DETAILED DESCRIPTION OF THE PREFERRED EMBODIMENTS

Figure 1:
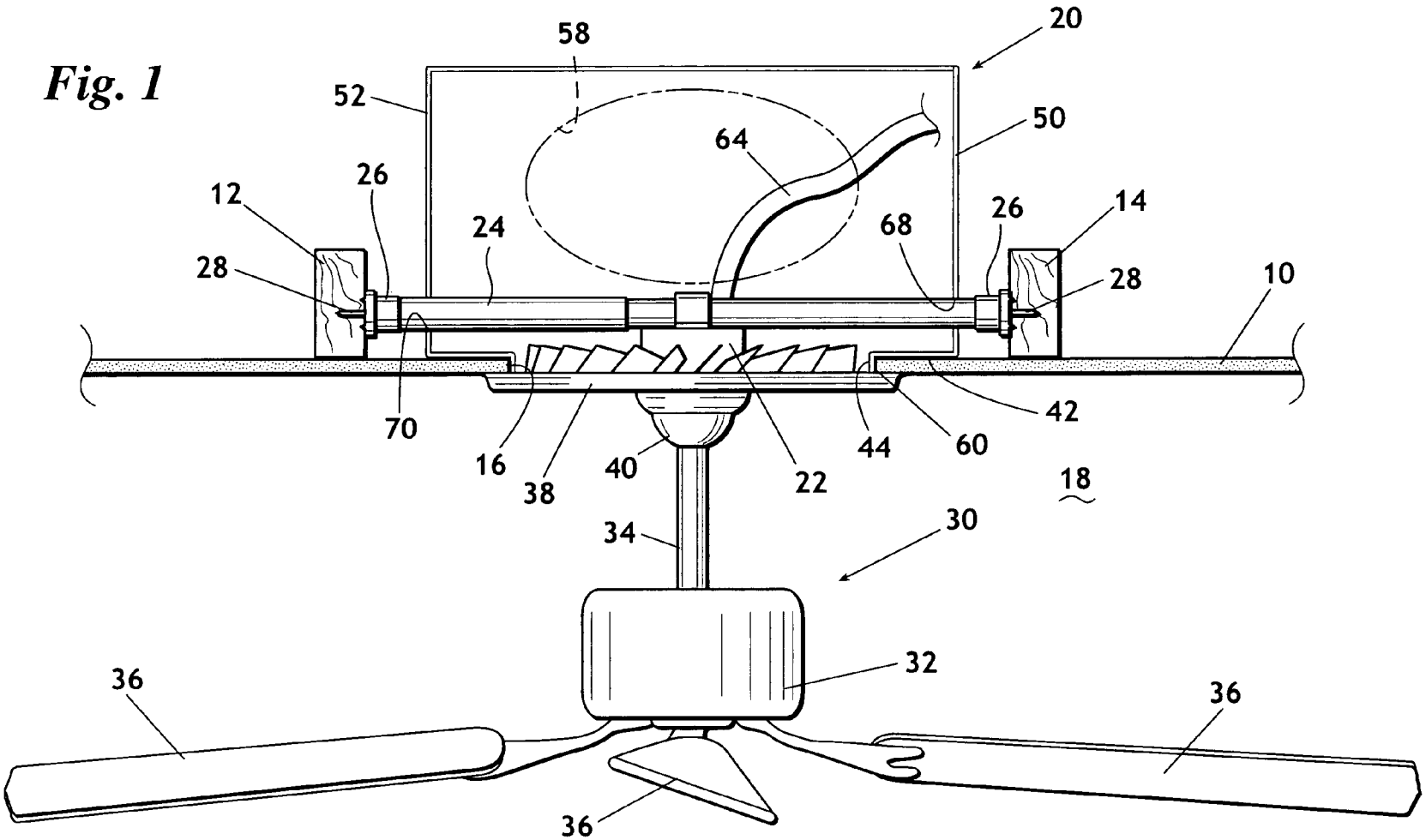
FIG. 1 is an elevational partially cross-sectional view showing a plenum of this invention as utilized in a heating, ventilating or air conditioning system in a typical residential construction. The view shows a ceiling of a room in cross-section, the ceiling being supported between paralleled, spaced-apart rafters. The Figure shows a plenum chamber of this invention supported to the ceiling between joists and shows a ceiling fan extending downwardly from the plenum. Affixed to the bottom of the plenum is a diffuser of the present invention, the diffuser serving to provide means for passing air into the room and for distributing the air. The ceiling fan is shown in external elevational view.

In the following table lists the number assigned to each important element illustrated in the drawings:

| | | | |
|---|---|---|---|
| 10 | ceiling | 68 | hanger opening |
| 12 | first ceiling joist | 70 | hanger opening |
| 14 | second ceiling joist | 72A-D | struts |
| 16 | opening | 74 | first rail |
| 18 | room | 76 | second rail |
| 20 | plenum housing | 78 | circumferential edge |
| 20A | alternate plenum housing | 80 | central opening |
| 22 | electrical junction box | 82 | smudge ring |
| 24 | hanger | 84 | radial air slot openings |
| 26 | flange like collars | 86 | air deflecting fin |
| 28 | wood screw | 88 | lower edge |
| 30 | ceiling fan | 90 | upper edge |
| 32 | motor housing | 92 | inner integral hinge portion |
| 34 | hanger pipe | 94 | outer integral hinge portion |
| 36 | horizontal fan blades | 95 | ring portion |
| 38 | diffuser | 96 | circular shield |
| 40 | bezel | 98 | damper/pattern shield |
| 42 | horizontal bottom | 100 | inner, semi-circular edge |
| 44 | opening | 102 | outer, semi-circular edge |
| 46 | first end | 104 | legs |
| 48 | second end | 106 | slots |
| 50 | first sidewall | 108 | legs |
| 52 | second sidewall | 110 | notches |
| 54 | sloped top | 112 | circumferential recess |
| 56 | air inlet opening | 114 | metal clips |
| 58 | flange | 116 | short length portion |
| 60 | flange | 118 | longer length portion |
| 62 | cover plate | 120 | large diameter opening |
| 64 | flexible conduit | 122 | sheetrock |
| 66 | connector | | |

Referring to the drawings and first to FIG. 1, one environment in which the invention herein is practiced is illustrated. FIG. 1 shows a ceiling 10 formed by sheetrock that separates the interior of a room from an attic space as is typically provided in residential construction. Ceiling 10 is supported by ceiling joists 12 and 14. The ceiling joists are typically spaced approximately 16–24 inches apart and are parallel to each other and horizontal, thereby support ceiling 10 in a horizontal position.

Formed in ceiling 10 is an opening 16 that is provided for the passage of air into the room 18. Positioned above opening 16 is a plenum housing generally indicated by numeral 20. The function of plenum housing 20 is to provide a means for attachment of a duct that is connected to a source of air used for heating, cooling and/or ventilating space 18.

One feature of plenum housing 20, as will be described in greater detail subsequently, is an electrical junction box 22. In the arrangement of FIG. 1, junction box 22 is structurally supported by means of a hanger 24 that has at each end thereof, flange-like collars 26 that each has at the other end thereof a wood screw 28 by which the collars are secured to ceiling joists 12 and 14.

In FIG. 1 there is shown supported to electrical junction box 22 a ceiling fan generally indicated by the numeral 30. Ceiling fan 30 includes a motor housing 32 that is supported at the lower end of a hanger pipe 34, the upper end of which is secured to junction box 22. Extending from a lower end of motor 32 are a plurality of horizontal fan blades 36. When the motor within housing 32 is energized, the fan blades are moved in a horizontal pattern to introduce turbulence into the air in room 18.

Closing the opening 18 in ceiling 10 is a diffuser 38 that will be described in detail subsequently. The function of diffuser 38 is to provide passageway for air to flow from plenum 20 into room 18 and to assist in distribution of the air as it enters the room. Further, diffuser 38 provides an estatic covering for opening 16.

As will be described subsequently, diffuser 38 has a central opening. Received on hanger pipe 34 is a decorative bezel that covers the central opening in diffuser 38.

Figure 2:
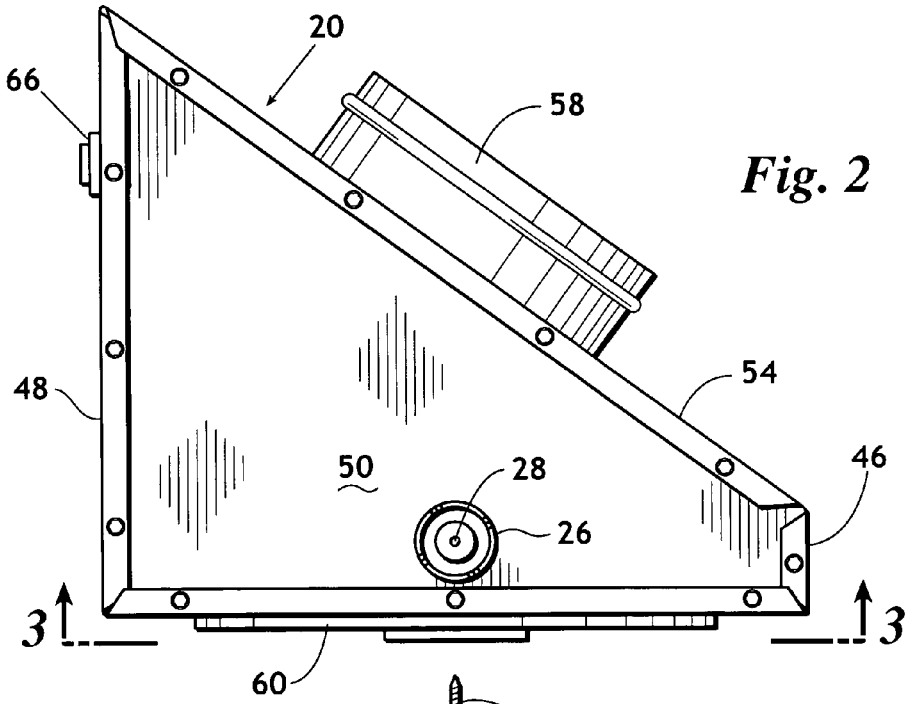
FIG. 2 is an elevational view of the plenum chamber.
Figure 3:
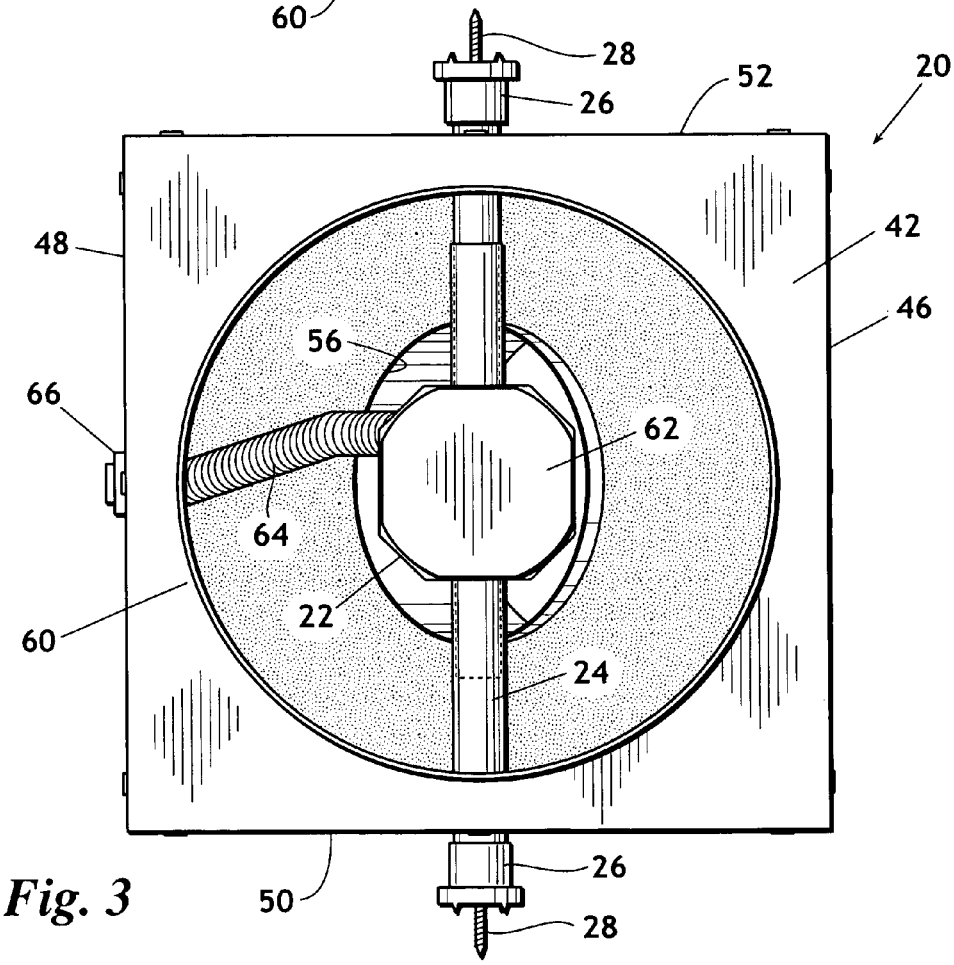
FIG. 3 is a bottom view as taken along the line 3—3 of FIG. 2. The plenum of FIGS. 2 and 3 is of the type specifically adapted to be mounted between wood ceiling joists as is typical in home construction in the United States and other areas where wood building materials are readily available.

FIGS. 2 and 3 show more details of plenum housing 20. The plenum has a horizontal bottom 42 having a large opening 44 that corresponds to the opening 16 in sheetrock 10 as seen in FIG. 1. Plenum housing 20 has a first vertical end 46 and a paralleled, opposed larger second vertical end 48. Further, the plenum housing has first and second vertical sidewalls 50 and 52. Sidewall 50 and 52 are equal-shaped trapezoids. A sloped top 54 completes the six-sided housing. Formed in slope top 54 is an air inlet opening 56 surrounded by a short length flange 58 that is configured to telescopically receive an air distribution duct (not shown in the drawings). Such distribution duct is typical of heating, ventilating and air conditioning systems by which air under pressure is delivered for distribution into the room 18 as seen in FIG. 1.

A short length flange 60 extends from large opening 44 in horizontal bottom 42. Flange 60 is configured to extend through opening 16 in sheetrock ceiling 10. Flange 60 is seen in FIGS. 1, 2 and 3.

Hanger 24 as shown in FIGS. 1 and 3 supports a fan and/or light and electrical junction box 22 to opposed ceiling joists, the ceiling joists not being shown in FIGS. 2 and 3. In FIG. 3, junction box 22 is shown with a cover plate 62 that is removed when a light fixture or a fan is supported to the junction box.

As seen in FIG. 3, a flexible conduit 64 extends from a connector 66 positioned in opening in second end 48 of plenum housing 20, the flexible conduit 64 extending within the housing to junction box 22. Conduit 64 serves as a means of passing electrical conductors from exterior of the plenum housing to junction box 22 by which electrical energy is supplied to a light and/or ceiling fan.

Plenum housing 20 is installed in this manner: first, it is positioned between ceiling joists 12 and 14, as seen in FIG. 1, with hanger 24 collapsed so that it is positionable between the ceiling joist and sheetrock installed after plenum is installed and with flange 60 extending within opening 16 in sheetrock 10. Second, hanger 24 is then extended so that the screws 28 engage the surfaces of joists 12 and 14. Third, the separate portions of hanger 24 are rotated to thread screws 28 into joists 12 and 14. Plenum housing 20 is thus secured in position and junction box 22 is supported in a way that it can retain the weight of a light fixture or ceiling fan that is affixed to it.

Hanger 24 extends through small diameter openings 68 and 70 in sidewalls 50 and 52 respectively, such openings being shown only in FIG. 1.

Figure 5:
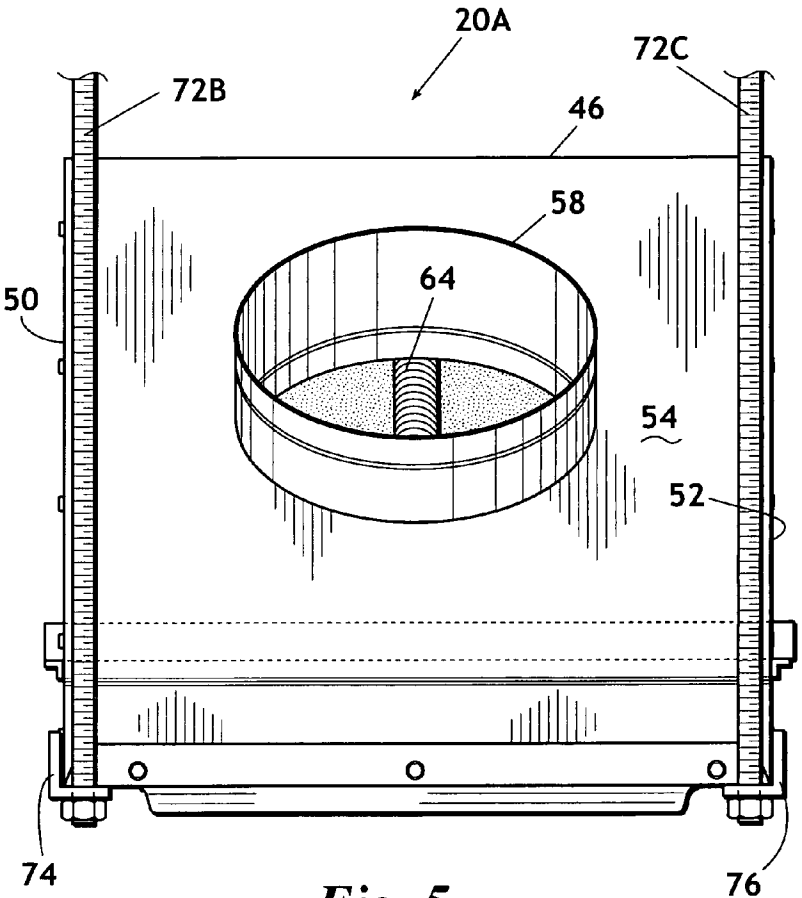
FIG. 5 is a front view of the plenum as illustrated in FIG. 4.
Figure 4:
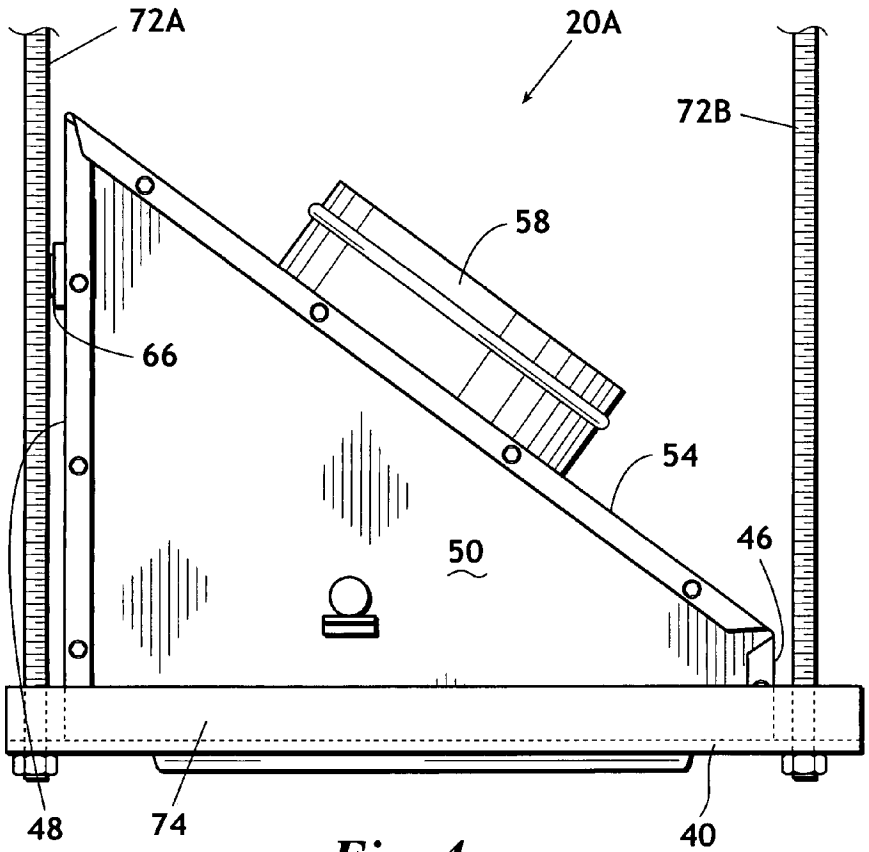
FIG. 4 is an elevational side view of a plenum of this invention in an arrangement wherein the plenum is for use in a commercial type construction—that is, wherein the plenum is not supported to ceiling joists, but instead wherein the plenum is hung from a support structure spaced above the ceiling. This may be referred to as a lay-in T-bar grid plenum.

FIGS. 4 and 5 show an alternate embodiment of the plenum housing, the alternate embodiment may be called a lay-in T-bar grid plenum, the alternate embodiment being designated as 20A. This embodiment that is intended for use in a commercial building, office building, school or the like that does not employ wood ceiling joists as is shown in FIG. 1. Instead, in the embodiment of FIGS. 4 and 5, plenum housing 20A is supported by four vertically depending struts 72A–72D. The struts may be in the form, as illustrated, of elongated threaded bolts. Extending between pairs of struts 72A–72D are opposed rails 74 and 76. The rails are angle-shaped and the horizontal bottom 42 of the plenum housing 20A rests on the rails 74 and 76, or the rails can be positioned across the bottom of the plenum for a lay-in T-bar grid plenum.

In the embodiment of FIGS. 4 and 5, extendable hangers of the type shown in FIGS. 1 and 3, are not employed and instead, fixed hangers are used but generally speaking, all other aspects of the alternate plenum housing 20A are the same as described for a plenum housing 20.

Figure 9:
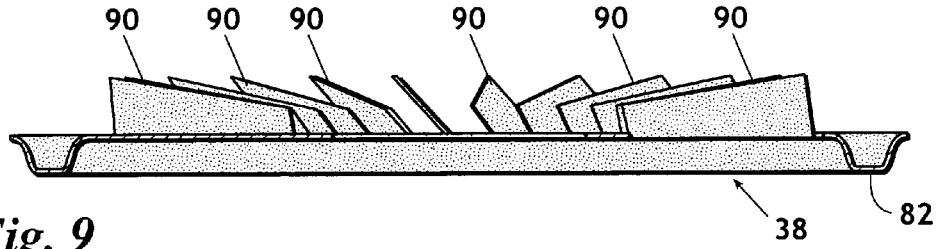
FIG. 9 is a cross-sectional view of the diffuser of this invention as taken along the line 9—9 of FIG. 8.
Figure 8:
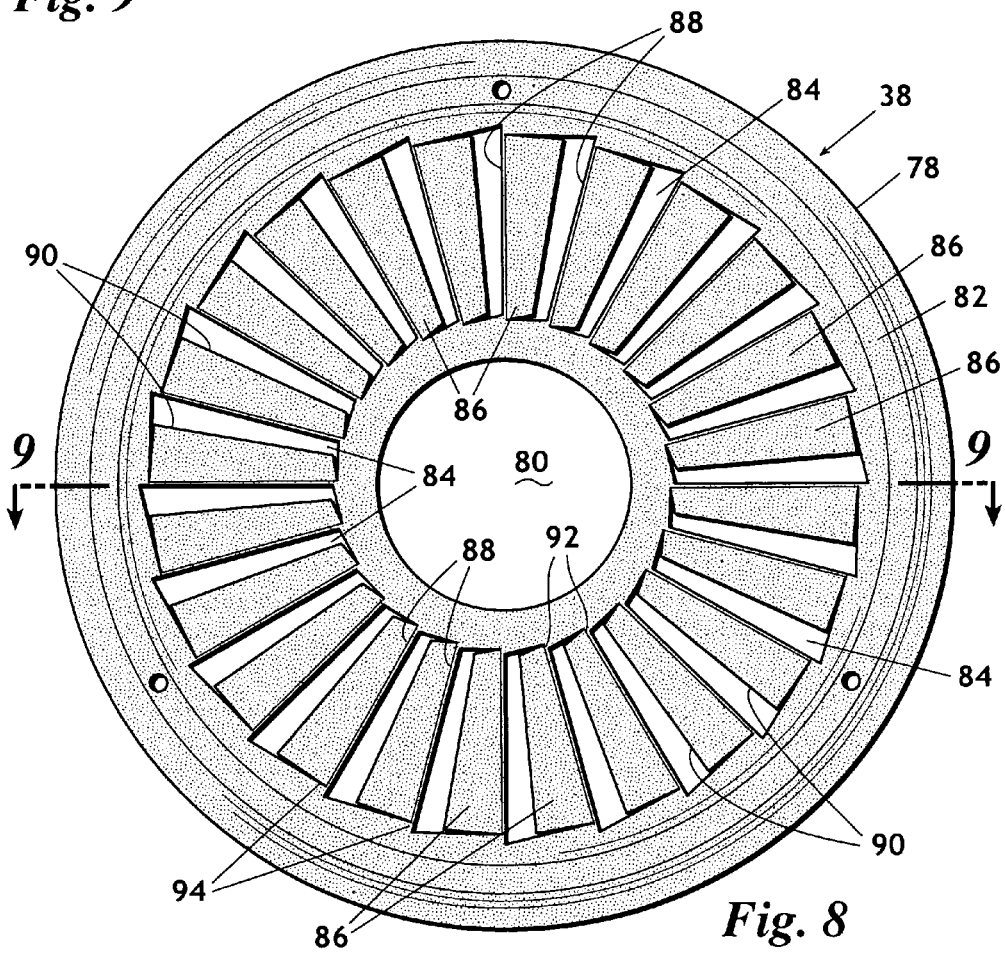
FIG. 8 is a bottom view of the diffuser alone—that is, wherein the diffuser is not shown in association with a plenum. Further.

An important feature of the invention is the provision of a diffuser 38 attached below ceiling 10 such as shown in FIG. 1, the diffuser being attached directly to the horizontal bottom of the plenum housing 20 or 20A or to the sheetrock 10. The diffuser 38 is shown in FIG. 1 but in greater detail in FIGS. 6, 8, 9, 11 and 12. FIGS. 8 and 9 show the improved diffuser alone. As seen in FIG. 8 the diffuser 38 is circular with an outer circumferential edge 78. Concentrically positioned within the circumferential edge is a central opening 80 that is dimensioned to communicate with the bottom open end of a junction box such as the junction box 22 shown in FIG. 1.

Adjacent circumferential edge 78 is a circular integral forwardly or downwardly protruding smudge ring 82. The element 82 is called a "smudge ring" since it serves to prevent direct radial passage of air coming out of the diffuser and to cause a slight downward inclination of the diffused air to thereby prevent the air from traveling along the interior surface of a ceiling, such as the surface of sheetrock 10 as shown in FIG. 1.

Radially extending from near central opening 80 to near smudge ring 82 are a plurality of air slot openings 84. Twenty-four such air slot openings 84 being shown in FIG. 8. Air slot openings 84 are formed in a plate of rigid material of which the diffuser 38 is manufactured. As each air deflecting fin 86 is punched out an air slot opening 84 is formed. The material punched out to form openings 84 is not fully severed from the blank material of which the diffuser is made; instead, the material that is displaced to provide openings 84 remains integrally hinged to diffuser 38. Each punched out and hinged air deflector fin 86 forms a radial slot opening 84. Each air deflector fin 86 is bent at a common angle to the plane of the diffuser. There is thereby one air deflecting fin 86 for each radial air slot opening 84. Each air deflecting fin 86 has a radially extending longitudinal lower edge 88 and a radially extending longitudinal upper edge 90. In this way, each of the air deflecting fins that is punched out has an inward integral hinged portion 92 that is adjacent to the central opening 80 and an outer integral hinge portion 94 that is adjacent to smudge ring 82. The space between integral hinged portions 92 of the air deflecting fins 86 and central opening 80 provides an integral toroidal ring portion 95 that adds structural rigidity to diffuser 38.

Thus, the diffuser is a generally planer, integral, circular structure formed of a sheet of rigid material and preferably a sheet of metal and having an uninterrupted circumferential outer edge and a central opening dimension to accommodate an electrical junction box, and having a plurality of radially extending partially punched-out fins that, after being punched out, are each bent to extend at a common angle to the plane of the structure, each bent fin providing a radially extending air slot opening. In addition, the circular structure is further defined by an inwardly formed concentric circular forwardly extending smudge ring that is circumferentially positioned between the fins and the circumferential outer edge.

The diffuser can be used in a variety of applications. For instance, if the diffuser is used to cover an opening in a ceiling, such as opening 16 in FIG. 1 in a situation where neither a ceiling light nor a ceiling fan is employed, then in that case, the use of an electrical junction box is not required, and the central opening 80 can be covered with a circular shield 96. When the diffuser is used to accommodate a ceiling light fixture or a fan, the circular shield 96 is not employed. Further, as shown in FIGS. 6 and 7, a semi-circular damper/pattern shield 98, can be secured to cover a portion of the radial air slot openings 84. FIG. 7 shows a plan view of damper/pattern shield 98. It is provided with an inner semi-circular edge 100 and has an outer semi-circular edge 102. The diameter of inner semi-circular edge 100 is equal to or slightly greater than the diameter of diffuser central opening 80. The outer semi-circular edge 102 is of diameter less than the diameter of smudge ring 82 so that thereby the damper/pattern shield can fit at selected positions on the face of the diffuser 38 to reduce the total cross-sectional area through which air can escape and thereby reduce the quantity of air emanating from the diffuser. Damper/pattern shield 98 can be made to cover a few or many of the radial air slot openings 84. Thus, damper/pattern shield 98, in the embodiment of FIG. 6, reduces the air passageway through the damper in proportion to its size.

Figure 10:
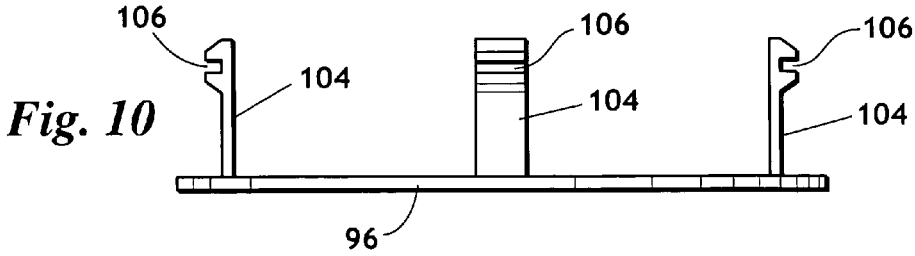
FIG. 10 is an elevational side view of the circular shield.

Circular shield 96 used to cover central opening 80 in the damper may be configured to provide for adjustable air flow. FIG. 10 shows an elevational view of an embodiment of circular shield 96 that has integrally formed legs 104. At least three such legs 104 are required, however, in the embodiment shown, four such legs are shown, one of the legs being obscured. Each leg 104 has on its outer surface an increased thickness portion that has a horizontal slot 106 therein. This slot can be fitted into central opening 80 so that thereby the circular shield is supported at a distance spaced from the front surface of the diffuser providing a circumferential radial air passageway. In this way, the circular shield 96 visually covers opening 80 but at the same time allows the passage of air therethrough reducing velocity and noise.

The damper/pattern shield is removably attached to a diffuser by the provision of integral boss protrusions or legs 108, each of which has a notch 110 that receives an edge of a diffuser slot opening 84.

Figure 11:
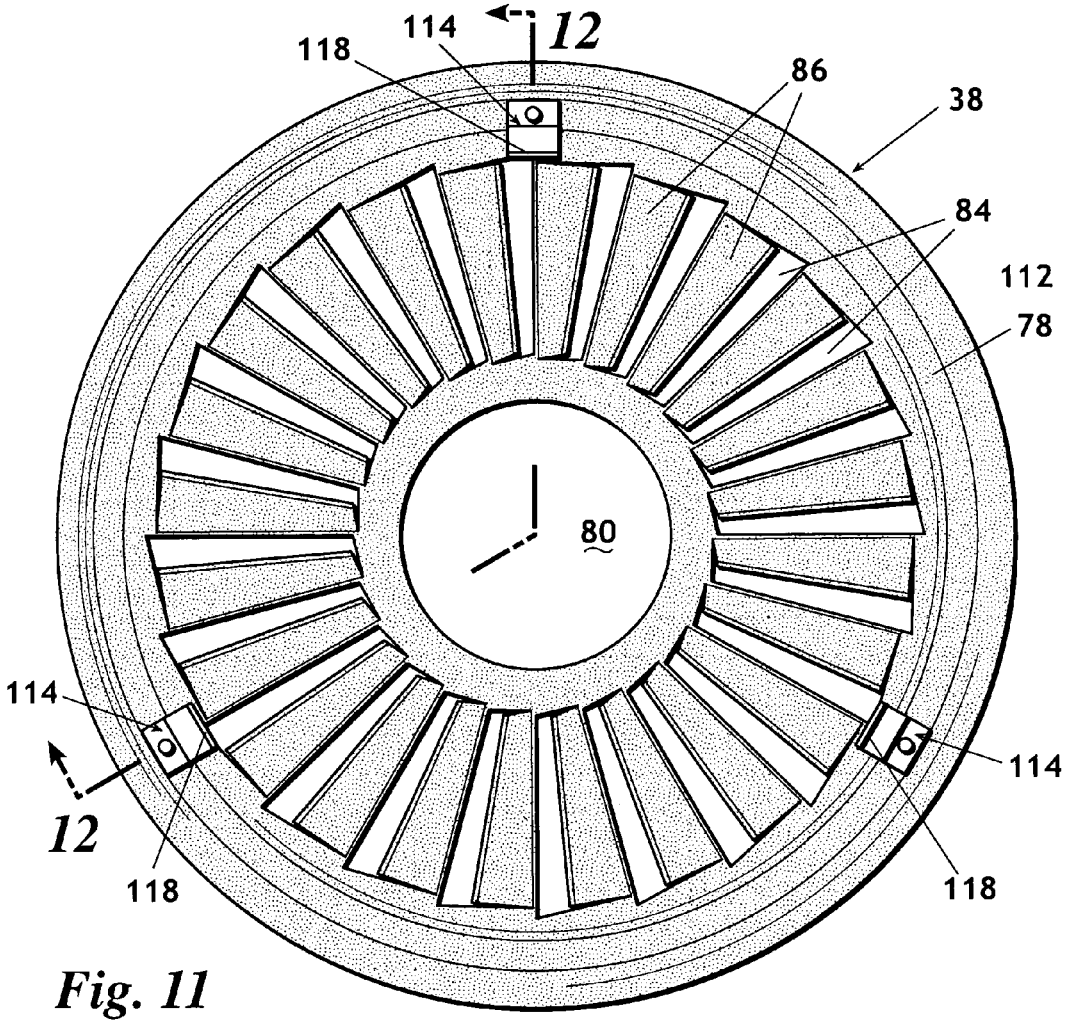
FIG. 11 is a bottom view of the diffuser showing the use of clips by which it can be held to cover an opening in a sheetrock ceiling.
Figure 13:
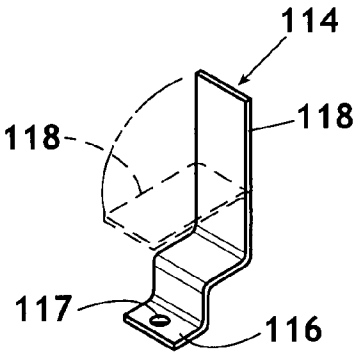
FIG. 13 is an isometric view of a clip for use with a diffuser showing in dotted outline how the clip is bent to hold the diffuser to an opening in a sheetrock ceiling and plenum housing.
Figure 12:
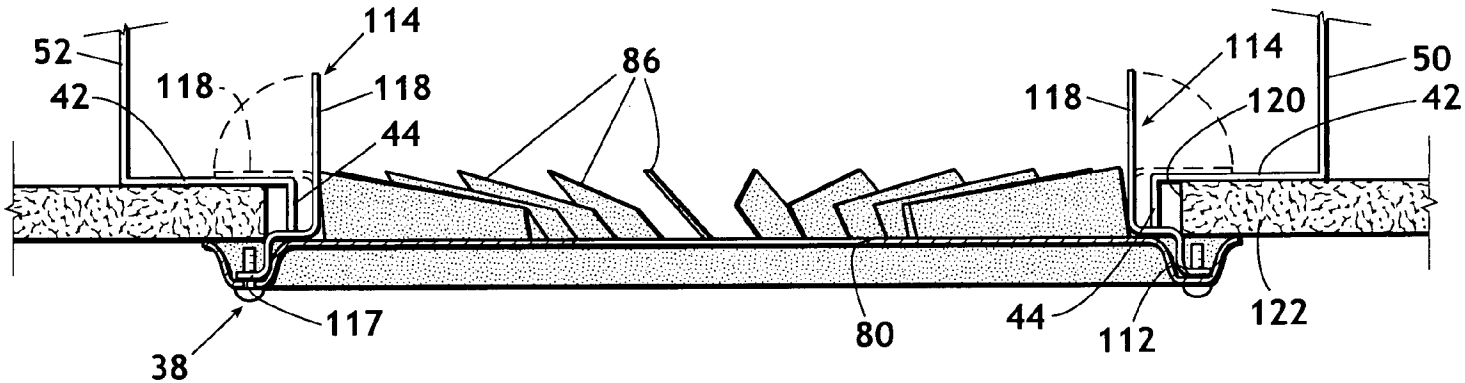
FIG. 12 is a cross-sectional view of the diffuser, taken along the line 12—12 of FIG. 11 and showing how the clips are used to attach the diffuser to a sheetrock ceiling and plenum housing.

Diffuser 38 can be secured to a plenum housing, such as plenum housing 20, by the use of screws or it may be mounted directly to a ceiling, also with screws. However, FIGS. 11, 12 and 13 illustrate a different way of affixing the diffuser to a ceiling formed of sheetrock or similar material. FIG. 11 shows the bottom view of diffuser 38 and shows a circumferential recess 112 that exists as a result of forming smudge ring 82 as seen in FIGS. 6, 8 and 9. Positioned within circumferential recess 112 is a plurality (three being shown) of metal clips 114. FIG. 13 is an isometric of a clip 114 showing the clip in its ready-to-use or manufactured state and in dotted outline—the shape the clip takes after it has been used. Clip 114 has a short length inner end portion 116 with a threaded bolt hole therein. This short length portion 116 is received in circumferential groove 112. A longer length outer end portion 118 extends perpendicular to a plane of diffuser 38 through opening 44 in plenum housing 20 to permit the diffuser with a plurality of clips to be positioned to cover a large diameter opening 120 in sheetrock 122 or other similar ceiling material. After clips 114 are positioned the longer length portion 118 of each clip is bent to overlie the inner surface of the horizontal bottom 42 of plenum housing 20 as shown in dotted outline in FIG. 12. If a junction box is not in place workman can bend the clip longer length portions 118 by extending a hand through diffuser central opening 120. A diffuser 38 can be mounted or removed by threading or unthreading bolts that pass through holes in the diffuser and engage threaded openings in the short length inner end portions 116 of clips 114.

The unique plenum housing and diffuser provide a simplified yet efficient way of installing an outlet opening of a HVAC system communicating into a room in a way to allow the plenum housing to be used for air distribution alone, for air distribution in combination with a light fixture, or air distribution in combination with a ceiling fan. It is common to attach a light fixture to the bottom of a ceiling fan. The innovative plenum housing and diffuser reduced clutter in the ceiling of a building and especially in the ceiling of a house so that one opening in a ceiling can serve to permit the distribution of air for heating, cooling and/or ventilation. Further, the same opening is used for a light fixture or a ceiling fan.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. For use with a HVAC plenum mounted above an opening in a ceiling, a diffuser having provision for accommodating a ceiling fan or a light fixture, the diffuser comprising:

a generally planar, integral, circular structure formed of thin, rigid material and having a circumferential outer edge and a central opening surrounded by an integral ring portion, the central opening being dimensioned to accommodate an electrical junction box, and having a plurality of punched out radial fins extending from said ring portion to near said circumferential outer edge, each fin being bent to extend at a common angle to the plane of the structure, a radially extending air slot opening being formed by each punched out fin.

2. A diffuser for use with a HVAC plenum according to claim 1 in which said circular structure is further defined by an integrally formed, concentric circular forwardly protruding smudge rind circumferentially positioned between said fins and said circumferential outer edge.

3. For use with a HVAC plenum according to claim 1 a circular cap that is removably attachable to said diffuser and dimensioned so as, when attached to said diffuser, covers said central opening but leaves said radially extending air slot openings unobstructed.

4. For use with a HVAC plenum according to claim 1 a planar damper configured to removably cover a preselected number of said radially extending air slot openings to providing means of selectably regulating the total area of exposed radially extending air slot openings.

5. A diffuser according to claim 1 including, in combination with said circular structure a plurality of bendable metal clips by which the circular structure is removably attachable to a ceiling panel having the circular opening therein, each clip being affixed at one end to said circular structure adjacent said circumferential outer edge to thereby extend through the circular opening and each clip being bendable to overlay the ceiling panel.

6. A diffuser according to claim 3 wherein said circular cap has an outer and an inner surface and including a plurality of at least three legs extending perpendicularly from said inner surface, each leg having at least one notch therein by which the circular cap may be spaced a selected distance from said circular structure outer face.

7. A diffuser according to claim 1 wherein each said punched out fin is integrally attached at an outer end to said structure adjacent said circumferential outer edge and is integrally attached at an inner end to said structure at said integral ring portion.

8. A diffuser according to claim 7 wherein one boundary of each said air slot opening is formed by said integral ring portion.

* * * * *